US005378572A

United States Patent [19]

Akiyama et al.

[11] Patent Number: 5,378,572

[45] Date of Patent: Jan. 3, 1995

[54] ELECTROPHOTOGRAPHIC DRY TONER AND PROCESS FOR PRODUCING THE SAME

[75] Inventors: Reiko Akiyama; Chiaki Suzuki; Atuhiko Eguchi; Takayoshi Aoki, all of Minami-shigara, Japan

[73] Assignee: Fuji Xerox Co., Ltd., Tokyo, Japan

[21] Appl. No.: 959,439

[22] Filed: Oct. 13, 1992

[30] Foreign Application Priority Data

Oct. 14, 1991 [JP] Japan ..... 3-291968
Feb. 14, 1992 [JP] Japan ..... 4-059203

[51] Int. Cl.[6] ..... G03G 9/08
[52] U.S. Cl. ..... 430/110; 430/903
[58] Field of Search ..... 430/106.6, 110, 903

[56] References Cited

U.S. PATENT DOCUMENTS 4,920,023 4/1990 Koch et al. ..... 430/110
4,965,158 10/1990 Gruber et al. ..... 430/110 X
5,155,000 10/1992 Matsumura et al. ..... 430/110
5,194,357 3/1993 Hodgson ..... 430/110 X

FOREIGN PATENT DOCUMENTS 211763 12/1983 Japan ..... 430/110
60-198556 10/1985 Japan .
61-231562 10/1986 Japan .
61-231563 10/1986 Japan .
248059 11/1986 Japan ..... 430/110
91142 4/1989 Japan ..... 430/110
2-89064 3/1990 Japan .

*Primary Examiner*—Roland Martin
*Attorney, Agent, or Firm*—Oliff & Berridge

[57] ABSTRACT

An electrophotographic dry toner comprising a binder resin and a colorant, having externally added thereto an inorganic compound, preferably spherical silica particles, having been surface treated with at least one treating agent selected from the group consisting of a treating agent selected from a polyethylene, a fatty acid metal salt, and a solid alcohol containing from 20 to 60 carbon atoms. The toner is prepared by treating the inorganic compound with a dispersion or a solution of the treating agent in a solvent and adding the thus surface-treated inorganic compound to a toner. The toner exhibits satisfactory fluidity, satisfactory cleanability, excellent environmental stability, and excellent durability and causes no toner filming phenomenon on a photoreceptor, a carrier used in a two-component developer system, or a charging part used in a one-component developer system.

7 Claims, No Drawings

ELECTROPHOTOGRAPHIC DRY TONER AND PROCESS FOR PRODUCING THE SAME

FIELD OF THE INVENTION

This invention relates to a dry toner for development of an electrostatic latent image in electrophotography or electrostatic recording and to a process for producing the same.

BACKGROUND OF THE INVENTION

Electrophotographic dry developers are divided into one-component developers, comprising a toner itself containing a binder resin having dispersed therein a colorant, and two-component developers comprising a toner and a carrier. In carrying out copying using either type of developer, an electrostatic latent image formed on a photoreceptor, etc. is visualized with the developer and transferred to paper. Toner remaining on the photoreceptor is then wiped off by cleaning.

Accordingly, a dry developer is required to satisfy various conditions in the copying step, particularly in the development step or cleaning step. That is, a toner should be used not in the form of agglomerates but in the form of independent particles. To this effect, it is required that the toner should have sufficient fluidity and that the flow characteristics or electrical characteristics of the toner should not be subject to variation with time or change in environmental conditions such as temperature and humidity.

In addition, the toner in a two-component developer is required to cause no filming phenomenon, i.e., adhesion of a toner, onto the surface of carrier particles.

Further, the residual toner on a photoreceptor should be easily wiped clean by means of a cleaning part, such as a blade or a web, without to scratching the photoreceptor.

For the purpose of meeting these requirements, it has been proposed to add to a one-component or two-component developer various external additives for improving fluidity, durability or cleanability, for example, inorganic powders (e.g., silica), organic powders (e.g., fatty acids, fatty acid metal salts, and derivatives thereof), and fluorine-containing resin powders.

Addition of the inorganic powders, such as silica, titania, and alumina, considerably improves fluidity but is liable to cause scratches on the surface of the photoreceptor because of their hardness. It easily follows that toner particles adhere to the scratched part of the photoreceptor.

On the other hand, regenerated paper has been steadily extending its use with the aim of resources-saving. In general, regenerated paper generates much paper dust, and the paper dust tends to enter the gap between a photoreceptor and a cleaning blade, causing cleaning defects, such as black streaks.

In order to overcome these problems, JP-A-60-198556 (the term "JP-A" as used herein means an "unexamined published Japanese patent application") proposes external addition of a fatty acid metal salt, and JP-A-61-231562 and JP-A-61-231563 propose external addition of a wax.

Any of these external additives proposed as a lubricant has a large particle size of from 3 to 20 μm. Accordingly, they should be added in a considerable amount to be made efficient use of. Besides, although these lubricants are effective in the initial stage, they themselves undergo filming, failing to form a uniform lubricating film, causing image defects, such as white spots and faint image.

JP-A-2-89064 suggests adding hydrophobic hard fine particles to a toner so that a photoreceptor is abraded by the hard fine particles to prevent toner filming. While effective to prevent filming, the hard particles cause wear on the surface of the photoreceptor, resulting in a serious reduction in durability of the photoreceptor. A cleaning blade is also worn out by the hard fine particles.

SUMMARY OF THE INVENTION

An object of the present invention is to provide an electrophotographic dry toner which exhibits satisfactory fluidity and satisfactory cleaning properties while retaining environmental stability and durability and which causes no toner filming on the surface of a photoreceptor, the surface of a carrier used in a two-component developer system, or the surface of a charging element used in a one-component developer system.

Another object of the present invention is to provide an electrophotographic dry toner which causes no reduction in the durability of a photoreceptor or a cleaning blade.

As a result of extensive investigations, the inventors have found that the above objects of the present invention are accomplished by using, as an external additive, an inorganic compound coated with a specific treating agent, and preferably by using spherical fine particles of a specific inorganic compound.

The present invention relates to an electrophotographic dry toner comprising a binder resin and a colorant, having externally added thereto an inorganic compound having been surface treated with at least one treating agent selected from the group consisting of a polyethylene, a fatty acid metal salt, and an alcohol containing from 20 to 60 carbon atoms which is solid at ordinary temperature.

The present invention also relates to a process for producing an electrophotographic dry toner comprising dispersing or dissolving at least one treating agent selected from the group consisting of a polyethylene, a fatty acid metal salt, and an alcohol containing from 20 to 60 carbon atoms which is solid at ordinary temperature in a solvent, treating the surface of an inorganic compound with the thus obtained dispersion or solution, and adding the resulting treated inorganic compound to a toner.

DETAILED DESCRIPTION OF THE INVENTION

The inorganic compound which can be externally added to a toner in the present invention includes $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O(TiO_2)_n$, $Al_2O_3.2SiO_2$, $CaCO_3$, $MgCO_3$, $BaSO_4$, and $MgSO_4$.

The inorganic compound preferably has an average primary particle size (hereinafter simply referred to as average particle size) of not more than 3.0 μm, more preferably 10 to 40 nm, and particularly 20 to 40 nm. The surface of the inorganic compound particles may be rendered hydrophobic.

Of the inorganic compounds, fine silica particles having a spherical shape are preferred. Of the spherical fine silica particles, those having a bulk density of 300 g/l or more and a density of 2.1 mg/mm$^3$ are particularly preferred.

The spherical fine silica particles can be obtained by a deflagration method, in which silicon and oxygen are reacted at a rate of several hundreds of meters per second. More specifically, silica particles are prepared by supplying metal silicon powder (average particle size: 1–30 μm; maximum particle size: 100 μm) into oxygen or air and hydrocarbon gas stream so that the supply is from 7 to 15 Kg/hr, lightening-up the reaction system, and subjecting the reaction system to combustion at a high temperature of 2000° C. or higher. According to the method, low-boiling impurities are preferentially evaporated and removed with the exhaust gas formed due to the high temperature, and as a result high purity silica particles can be obtained. Further, a rinse treatment using mineral acid, etc., may be carried out prior to the combustion treatment.

The fine silica particles obtained by a deflagration method generally have a true spherical shape with a smooth surface and a narrow particle size distribution and are therefore effective to improve cleanability of a toner.

The spherical fine silica particles to be used usually have an average particle size of from 0.05 to 3.0 μm, preferably 0.1 to 1.0 μm, and particularly 0.2 to 0.7 μm. If the particle size exceeds 3.0 μm, the particles would act as a spacer between a blade and a photoreceptor to let toner particles to be wiped off escape therethrough.

The treating agent which can be used to coat the surface of the inorganic compound is selected from a polyethylene, a fatty acid metal salt, and an alcohol which contains from 20 to 60 carbon atoms and is solid at ordinary temperatures (hereinafter referred to as a solid alcohol). Of these, polyethylene is most preferred.

The term "ordinary temperatures" as used herein means a temperature of 15° to 25° C.

The polyethylene may have a low to high density and preferably has a specific gravity of not less than 0.9 and a molecular weight of not more than 50000, more preferably not more than 9000, and particularly preferably from 1000 to 2000. The lower limit of the molecular weight of the polyethylene is 700.

Examples of the fatty acid metal salt include, but are not limited to, aluminum stearate, calcium laurate, calcium myristate, calcium stearate, zinc laurate, zinc myristate, zinc stearate, and magnesium stearate. Of these, zinc stearate is particularly preferred.

The solid $C_{20-60}$ alcohol may be a single solid alcohol or a mixed solid alcohol comprising a plurality of solid alcohols different in carbon atom number. The solid alcohol has an average molecular weight usually of from about 290 to 860, and preferably of from 320 to 750. Straight chain alcohols are preferred. A solid alcohol containing less than 20 carbon atoms has insufficient crystallinity to form a film of sufficient strength. As a result, as hereinafter stated, the thin film formed thereby on a fixed toner image reduces friction but has poor mechanical strength resistant to rubbing. A solid alcohol containing more than 60 carbon atoms has low filming properties, failing to produce sufficient lubricating effects. Therefore, solid $C_{20-60}$ can have high crystallinity and sufficient lubricating effects.

The amount of the treating agent selected from the polyethylene, fatty acid metal salt, and solid alcohol to be adhered on the inorganic compound preferably ranges from 2 to 50% by weight, and more preferably ranges from 10 to 20% by weight based on the inorganic compound.

The treatment of the inorganic compound with the above-mentioned treating agent is carried out by dispersing or dissolving the treating agent in an appropriate solvent and treating the inorganic compound with the dispersion or solution by means of a kneader, or by spray drying, or by fluidized bed coating. The manner of treatment is not particularly limited provided that the treating agent is dispersed or dissolved in a solvent. If desired, the surface treated inorganic compound may be subjected to grinding, classification, and sieving.

Examples of the solvent used for dispersing or dissolving the treating agent include xylene, toluene, isopropanol, ethylbenzene, and tetrahydrofuran.

The thus surface-treated inorganic compound, which is apt to aggregate to have a large average particle size, preferably has an average particle size of not more than 5 μm, more preferably not more than 3 μm and most preferably from 20 nm to 1.0 μm. The lower limit of the average particle of the surface-treated inorganic compound is 10nm. The proportion of particles greater than 5 μm, if any, is preferably not more than 10% (population).

The surface-treated inorganic compound is added to a toner preferably in an amount of from about 0.1 to 10% by weight based on the total weight of the toner.

The electrophotographic dry toner of the present invention mainly comprises a binder resin and a colorant.

Examples of useful binder resins include homo- or copolymers of styrene or derivatives thereof, e.g., chlorostyrene; mono-olefins, e.g., ethylene, propylene, butylene, and isobutylene; vinyl esters, e.g., vinyl acetate, vinyl propionate, vinyl butyrate, and vinyl benzoate; α-methylene aliphatic monocarboxylic acid esters, e.g., methyl acrylate, ethyl acrylate, butyl acrylate, octyl acrylate, dodecyl acrylate, phenyl acrylate, methyl methacrylate, ethyl methacrylate, butyl methacrylate, and dodecyl methacrylate; vinyl ethers, e.g., vinyl methyl ether, vinyl ethyl ether, and vinyl butyl ether; and vinyl ketones, e.g., vinyl methyl ketone, vinyl hexyl ketone, and vinyl isopropenyl ketone. Typically employed binder resins among them are polystyrene, polyethylene, polypropylene, a styrene-alkyl acrylate copolymer, a styrene-alkyl methacrylate copolymer, a styrene-acrylonitrile copolymer, a styrene-butadiene copolymer, and a styrene-maleic anhydride copolymer. In addition, polyester resins, polyurethane resins, epoxy resins, silicone resins, polyamide resins, modified rosin, paraffin, and waxes are also employable.

Examples of useful colorants include carbon black, Aniline Blue, Chalcoil Blue, Chrome Yellow, Ultramarine Blue, Dupon Oil Red, Quinoline Yellow, Methylene Blue chloride, Phthalocyanine Blue, Malachite Green oxalate, Lamp Black, and Rose Bengale. A part or the whole of the colorant may be replaced with a magnetic powder. Useful magnetic powders include magnetite, ferrite, iron powder, and nickel powder.

If desired, the toner of the present invention may further contain other additives, such as fluidity improving agents, such as amorphous silica fine powder, charge control agents, cleaning aids, and waxes.

The above-mentioned surface-treated inorganic compound is added to toner particles and mixed therewith. Mixing is carried out by means of, e.g., a V-type mixer or a Henschel mixer.

The surface-treated inorganic compound may be adhered merely physically or fixed loosely to the surface of the toner particles. Further, it may cover the entire surface or a part of the surface of the toner particles. The surface-treated inorganic compound on the toner particles may be partly agglomerated but preferably forms a mono-particulate layer.

The thus obtained toner has an average particle size usually of not more than 30 μm, and preferably of from 3 to 20 μm. The toner may be a magnetic toner containing a magnetic material or a capsule toner.

The electrophotographic toner having added thereto the surface-treated inorganic compound can be used as a one-component developer or as a toner component of a two-component developer. Carriers to be used in a two-component developer include iron powder, glass beads, ferrite powder, nickel powder, each of which may have a resin coat.

The toner of the present invention is used for developing an electrostatic latent image formed on a photoreceptor or an electrostatic recording medium. In more detail, an electrostatic latent image is electrophotographically formed on a photoreceptor comprising an inorganic photoconductive material, such as selenium, zinc oxide, cadmium sulfide, or amorphous silicon, or an organic photoconductive material, such as a phthalocyanine pigment or a bisazo pigment, or an electrostatic latent image is formed on an electrostatic recording medium having a dielectric, such as polyethylene terephthalate, by means of a needle electrode, etc. The toner is adhered onto the latent image by magnetic brush development, cascade development, touch-down development or a like process to form a toner image. The toner image is transferred to a transfer material, such as paper, and fixed. The toner remaining on the photoreceptor or recording medium is then removed by cleaning.

Cleaning can be performed by means of a blade, a web fur brush, a roll, etc. The excellent cleanability of the dry toner of the present invention is particularly exhibited in cleaning using a blade.

According to the process of the present invention, the surface-treated inorganic compound can be obtained with a very small particle size. The surface-treated inorganic compound, when externally added to toner particles, is uniformly adhered to the surface of the toner particles.

The polyethylene, fatty acid metal salt or solid alcohol adhered to the inorganic compound exhibits a lubricating effect to form a lubricating film on the surface of a photoreceptor. The lubricating film reduces the friction between a cleaning blade and the photoreceptor to thereby improve cleaning performance.

As a secondary effect of the present invention, the surface-treated inorganic compound acts as a fluidity-improving agent to show an anti-frictional effect. Therefore, even in using a hard inorganic oxide fine powder or magnetite as in a magnetic toner, the wear of an organic photoreceptor can be minimized by such an anti-frictional effect.

In addition, the inorganic compound surface-treated with a polyethylene or a solid alcohol forms a thin film on the surface of a toner image during fixing to provide a fixed toner image having improved resistance to rubbing with a roller when subjected to double side copying or delivery.

In particular, where the inorganic compound is a spherical fine silica powder, it is hard and not liable to deform so that filming of the fine silica powder itself on a photoreceptor can be prevented during cleaning at a high speed and under a high load.

Further, the surface-treated spherical fine silica powder serves as a roller because of its shape to reduce the friction between a photoreceptor and a cleaning blade thereby improving cleaning performance. In particular, the fine silica powder prepared by a deflagration method has an almost true spherical shape with a smooth surface and exhibits excellent cleaning performance without damaging the surface of a photoreceptor. The excellent cleaning performance of the spherical fine silica powder can be taken full advantage of when its average particle size falls within a range of from 0.05 to 3.0 μm. Such a small-sized powder causes no reduction in powder the fluidity of the toner.

For some unknown reasons, the surface-treated spherical fine silica powder has substantially no adverse influence on the charging characteristics of the toner so that it is applicable to both positive and negative developers. The deterioration of the developer due to contamination of a carrier can be minimized.

EXAMPLES

The present invention is now illustrated in greater detail with reference to the following Examples and Comparative Examples, but it should be understood that the present invention is not to be construed as being limited thereto. All the parts, percents, and ratios are given by weight unless otherwise indicated.

The external additives used in the Examples and Comparative Examples were prepared as follows.

Preparation of Additive A:

Polyethylene "200 P" (a product of Mitsui Petrochemical Industries, Ltd.; specific gravity: 0.97; molecular weight: 5000) was dispersed in xylene and dissolved in a hot water bath at about 90° C. To the resulting xylene solution was added hydrophobic silica having an average particle size of 0.016 μm in such an amount that the amount of the polyethylene corresponded to 20% by weight of the hydrophobic silica. After stirring, the mixture was degassed and dried by means of an evaporator. The dry product was ground in an automatic mortar and sifted through a 106 μm mesh sieve to obtain polyethylene-treated silica having an average particle size of about 0.1 μm.

Preparation of Additive B:

Polyethylene "Ceridust 3620" (a product of Hoechst A.G.; specific gravity: 0.97; molecular weight: 9000) was dispersed in xylene. Hydrophobic silica having an average particle size of 0.016 μm was stirred in a kneader while soaked with the xylene dispersion, the polyethylene dispersion added thereto in such an amount that the amount of the polyethylene corresponded to 20% by weight of the silica, and the mixture stirred while heating. The mixture was degassed and dried, followed by grinding in a jet mill to obtain polyethylene-treated silica having an average particle size of about 0.05 μm.

Preparation of Additive C:

In the same manner as for Additive A, except for replacing silica with alumina having an average particle size of 0.01 μm, polyethylene-treated alumina having an average particle size of about 0.08 μm was obtained.

Preparation of Additive D:

Polyethylene "PE-190" (a product of Hoechst A.G.; specific gravity: 0.96; molecular weight: 40000) was dispersed in xylene and dissolved in a hot water bath at about 90° C. To the resulting xylene solution was added hydrophobic silica having an average particle size of 0.016 μm in such an amount that the amount of the polyethylene corresponded to 20% by weight of the hydrophobic silica. After stirring, the mixture was degassed and dried by means of an evaporator. The dry product was ground in an automatic mortar and sifted through a 106 μm mesh sieve to obtain polyethylene-treated silica having an average particle size of about 0.8 μm.

Preparation of Additive E:

In the same manner as for Additive A, except for replacing the hydrophobic silica with titania having an average particle size of 0.05 μm, polyethylene-treated titania having an average particle size of about 0.2 μm was obtained.

Preparation of Additive F:

Polyethylene "100 P" (a product of Mitsui Petrochemical Industries, Ltd.; specific gravity: 0.95; molecular weight: 1800) was dispersed in xylene and dissolved in a hot water bath at about 90° C. To the resulting xylene solution was added hydrophobic silica having an average particle size of 0.012 μm in such an amount that the amount of the polyethylene corresponded to 30% by weight of the hydrophobic silica. After stirring, the mixture was degassed and dried by means of an evaporator. The dry product was ground in an automatic mortar and sifted through a 106 μm mesh sieve to obtain polyethylene-treated silica having an average particle size of about 0.08 μm.

Preparation of Additive G:

Polyethylene "200 P" was freeze-ground and classified to remove coarse particles to obtain fine polyethylene particles having an average particle size of about 9 μm.

Preparation of Additive H:

Zinc stearate was dispersed in xylene and dissolved in a hot water bath at about 90° C. To the resulting xylene solution was added hydrophobic silica having an average particle size of 0.012 μm in such an amount that the amount of the zinc stearate corresponded to 20% by weight of the hydrophobic silica. After stirring, the mixture was degassed by means of an evaporator and dried. The dry product was ground in an automatic mortar and sifted through a 106 μm mesh sieve to obtain zinc stearate-treated silica having an average particle size of about 0.03 μm.

Preparation of Additive I:

Calcium laurate was dispersed in tetrahydrofuran and dissolved in a hot water bath at about 65° C. To the resulting tetrahydrofuran solution was added hydrophobic silica having an average particle size of 0.012 μm in such an amount that the amount of the calcium laurate corresponded to 30% by weight of the hydrophobic silica. After stirring, the mixture was degassed by means of an evaporator and dried. The dry product was ground in an automatic mortar and sifted through a 106 μm mesh sieve to obtain calcium laurate-treated silica having an average particle size of about 0.05 μm.

Preparation of Additive J:

Magnesium stearate was dispersed in ethylbenzene and dissolved in a hot water bath at about 90° C. To the resulting ethylbenzene solution was added alumina having an average particle size of 0.010 μm in such an amount that the amount of the magnesium stearate corresponded to 20% by weight of the alumina. After stirring, the mixture was degassed by means of an evaporator and dried. The dry product was ground in an automatic mortar and sifted through a 106 μm mesh sieve to obtain magnesium stearate-treated alumina having an average particle size of about 0.03 μm.

Preparation of Additive K:

A zinc stearate/isopropanol sol (dispersed particle size: about 0.03 μm) was prepared, and hydrophobic silica having an average particle size of 0.012 μm was stirred in a kneader while soaked with an isopropanol solvent. The zinc stearate/isopropanol sol was added thereto in such an amount that the amount of the zinc stearate corresponded to 20% by weight of the hydrophobic silica, and the mixture was stirred while heating. The mixture was degassed and dried, followed by grinding in a jet mill to obtain zinc stearate-treated silica having an average particle size of about 0.05 μm.

Preparation of Additive L:

Zinc stearate was ground to obtain fine particles having an average particle size of about 5.0 μm.

Preparation of Additive M:

A solid alcohol (carbon atom number: about 25; molecular weight: 360; Mw/Mn=1.05) was dispersed in toluene and dissolved in a hot water bath at about 70° C. Hydrophobic silica having an average particle size of 0.016 μm was added to the toluene solution in such an amount that the amount of the solid alcohol corresponded to 20% by weight of the hydrophobic silica, followed by stirring. The mixture was degassed by means of an evaporator and dried. The dry product was ground in an automatic mortar and sifted through a 106 μm mesh sieve to obtain alcohol-treated silica having an average particle size of about 0.08 μm.

Preparation of Additive N:

A solid alcohol (carbon atom number: about 30; molecular weight: 450; Mw/Mn=1.10) was dispersed in toluene. Hydrophobic silica having an average particle size of 0.016 μm was stirred in a kneader while soaked with the toluene dispersion. The toluene dispersion was added thereto in such an amount that the amount of the solid alcohol corresponded to 20% by weight of the hydrophobic silica. The mixture was stirred while heating, degassed, dried, and ground in a jet mill to obtain alcohol-treated silica having an average particle size of about 0.05 μm.

Preparation of Additive O:

In the same manner as for Additive M, except for using a solid alcohol (carbon atom number: about 30; molecular weight: 450; Mw/Mn=1.10) and alumina having an average particle size of 0.01 μm, alcohol-treated alumina having an average particle size of about 0.05 μm was obtained.

Preparation of Additive P:

In the same manner as for Additive M, except for using a solid alcohol (carbon atom number: about 50; molecular weight: 720; Mw/Mn=1.48) and hydrophobic silica having an average particle size of 0.016 μm, alcohol-treated silica having an average particle size of about 0.10 μm was obtained.

Preparation of Additive Q:

In the same manner as for Additive O, except for replacing alumina with titania having an average particle size of 0.05 μm, alcohol-treated titania having an average particle size of about 0.2 μm was obtained.

Preparation of Additive R:

A solid alcohol (carbon atom number: about 30; molecular weight: 450; Mw/Mn=1.10) was dispersed in toluene and dissolved in a hot water bath at about 90° C. Hydrophobic silica having an average particle size of 0.012 μm was treated with the resulting dispersion by spray drying to obtain alcohol-treated silica having an average particle size of about 0.03 μm.

Preparation of Additive S:

A solid alcohol (carbon atom number: about 30; molecular weight: 450; Mw/Mn=1.10) was ground in a jet mill, and the coarse particle were removed by classification to obtain solid alcohol particles having an average particle size of about 8 μm.

The particulars of the preparation of Additives A to S and the population of particles of 5 μm or greater in the resulting additive are shown in Tables 1 and 2 below. The average particle size (50 vol % diameter) of the resulting additive and the population of particles of 5 μm or greater in the additive were obtained from an electron micrograph obtained under a transmission electron microscope "H-900" (manufactured by Hitachi, Ltd.) at a magnification of 300000.

TABLE 1

| | Treating Agent | | Inorganic Compound | | Size Distribution of Additives | |
|---|---|---|---|---|---|---|
| | | | | | Average Particle Size | Proportion of ≧5 μm |
| Additive | Kind | Amount (wt %) | Kind | Size (μm) | D50 (vol) (μm) | Particles (%) |
| A | polyethylene | 20 | hydrophobic silica | 0.016 | 0.10 | 0.8 |
| B | " | " | hydrophobic silica | " | 0.05 | 0.2 |
| C | " | " | alumina | 0.010 | 0.08 | 0.6 |
| D | " | " | hydrophobic silica | 0.016 | 0.80 | 3.2 |
| E | " | " | titania | 0.050 | 0.20 | 1.0 |
| F | " | 30 | hydrophobic silica | 0.012 | 0.08 | 0.5 |
| G | " | — | — | — | 9.00 | 50.0 |
| H | zinc stearate | 20 | hydrophobic silica | 0.012 | 0.03 | 0.2 |
| I | calcium laurate | 30 | hydrophobic silica | " | 0.05 | 1.0 |
| J | magnesium stearate | 20 | alumina | 0.010 | 0.03 | 0.6 |
| K | zinc stearate | 20 | hydrophobic silica | 0.012 | 0.05 | 0.1 |
| L | zinc stearate | — | — | — | 5.00 | 4.0 |

TABLE 2

| | Treating Agent | | Inorganic Compound | | Size Distribution of Additive | |
|---|---|---|---|---|---|---|
| | | | | | Average Particle Size | Proportion of ≧5 μm |
| Additive | Kind | Amount (wt %) | Kind | Size (μm) | D50 (vol) (μm) | Particles (%) |
| M | solid alcohol (mol. wt.: 360) | 20 | hydrophobic silica | 0.016 | 0.08 | 0.6 |
| N | solid alcohol (mol. wt.: 450) | " | hydrophobic silica | " | 0.05 | 0.3 |
| O | solid alcohol (mol. wt.: 450) | " | alumina | 0.010 | 0.05 | 0.4 |
| P | solid alcohol (mol. wt.: 720) | " | hydrophobic silica | 0.016 | 0.10 | 1.0 |
| Q | solid alcohol (mol. wt.: 450) | " | titania | 0.050 | 0.20 | 0.8 |
| R | solid alcohol (mol. wt.: 450) | " | hydrophobic silica | 0.012 | 0.03 | 0.1 |
| S | solid alcohol (mol. wt.: 450) | — | — | — | 8.00 | 70.0 |

Preparation of Additive a:

Polyethylene "200 P" was dispersed in xylene and dissolved in a hot water bath at about 90° C. To the resulting xylene solution was added spherical fine silica particles having an average particle size of 0.7 μm and a bulk density of about 500 g/l in such an amount that the amount of the polyethylene corresponded to 20% by weight of the spherical silica particles. After stirring, the mixture was degassed by means of an evaporator and dried. The dry product was ground in an automatic mortar and sifted through a 106 μm mesh sieve to obtain polyethylene-treated spherical fine silica particles.

The bulk density of the spherical fine silica particles was measured as follows (hereinafter the same). Silica particles were slowly put into a 100 ml-measuring cylinder to a scale of 100 ml while giving no vibration to the cylinder, and the weight of the silica particles of this volume was measured. The bulk density was calculated from equation:

$$\text{Bulk density } (g/l) = \text{Weight } (g/100\ ml) \times 10$$

Preparation of Additive b:

In the same manner as for Additive a, spherical fine silica particles having an average particle size of 0.05 μm and a bulk density of about 350 g/l were treated with 30% of polyethylene.

Preparation of Additive c:

In the same manner as for Additive a, spherical fine silica particles having an average particle size of 3.0 μm and a bulk density of about 520 g/l were treated.

Preparation of Additive d:

Polyethylene "Ceridust 3620" was dispersed in xylene. Spherical fine silica particles having an average particle size of 0.7 μm and a bulk density of about 500 g/l were stirred in a kneader while soaked with the xylene dispersion, and the xylene dispersion was added thereto in such an amount that the amount of the polyethylene corresponded to 20% by weight of the silica, followed by stirring while heating. The mixture was degassed and dried, followed by grinding in a jet mill to obtain polyethylene-treated spherical silica particles.

Preparation of Additive e:

Polyethylene-treated spherical fine silica particles were obtained in the same manner as for Additive a, except for using polyethylene "PE-190" as a treating agent.

Preparation of Additive f:

Polyethylene-treated spherical fine silica particles were obtained in the same manner as for Additive b, except for using spherical fine silica particles having an average particle size of 0.1 μm and a bulk density of about 400 g/l and polyethylene "100 P" as a treating agent.

Preparation of Additive g:

In the same manner as for Additive a, spherical fine silica particles were treated with zinc stearate as a treating agent.

Preparation of Additive h:

In the same manner as for Additive f, calcium laurate-treated spherical fine silica particles were obtained by using a calcium laurate solution in tetrahydrofuran heated in a hot water bath at about 65° C.

Preparation of Additive i:

In the same manner as for Additive a, magnesium stearate-treated spherical fine silica particles were obtained by using magnesium stearate as a treating agent and ethylbenzene as a solvent.

Preparation of Additive j:

A zinc stearate/isopropanol sol (dispersed particle size: about 0.03 μm) was prepared, and spherical fine silica particles having an average particle size of 0.7 μm and a bulk density of about 500 g/l were stirred in a kneader while soaked with an isopropanol solvent. The zinc stearate/isopropanol sol was added thereto in such an amount that the amount of the zinc stearate corresponded to 20% by weight of the silica, and the mixture was stirred while heating. The mixture was degassed and dried, followed by grinding in a jet mill to obtain zinc stearate-treated spherical fine silica particles.

Preparation of Additive k:

A solid alcohol (carbon atom number: about 20; molecular weight: 300; Mw/Mn=1.05) was dispersed in toluene and dissolved in a hot water bath at about 70° C. Spherical fine silica particles having an average particle size of 0.7 μm were added to the toluene solution in such an amount that the amount of the solid alcohol corresponded to 20% by weight of the silica, followed by stirring. The mixture was degassed by means of an evaporator and dried. The dry product was ground in an automatic mortar and sifted through a 106 μm mesh sieve to obtain alcohol-treated spherical fine silica particles.

Preparation of Additive l:

A solid alcohol (carbon atom number: about 30; molecular weight: 450; Mw/Mn=1.10) was dissolved in toluene, and spherical fine silica particles having an average particle size of 0.7 μm were stirred in a kneader while soaked in the toluene solution. The toluene solution was then added thereto in such an amount that the amount of the solid alcohol corresponded to 20% by weight of the silica, followed by stirring under heating. The mixture was degassed by means of an evaporator and dried. The dry product was ground in a jet mill to obtain alcohol-treated spherical fine silica particles.

Preparation of Additive m:

A solid alcohol (carbon atom number: about 63; molecular weight: 900; Mw/Mn=1.48) was dispersed in toluene and dissolved in a hot water bath at about 90° C. Spherical fine silica particles having an average particle size of 0.7 μm were treated with the resulting dispersion in such an amount that the solid alcohol corresponded to 20% by weight of the silica particles. Following spray drying, alcohol-treated spherical fine silica particles were obtained.

Preparation of Additive n:

Silicon carbide fine particles having an average particle size of 0.5 μm were surface treated with a titanium coupling agent to obtain a hard fine powder.

The average particle size of Additives a to n thus prepared was almost the same as that before surface treating.

The particulars of Additives a to n are shown in Table 3 below.

TABLE 3

| Additive | Particle size of Spherical Silica Before Treatment (μm) | Treating Agent Kind | Treating Agent Amount (wt %) |
|---|---|---|---|
| a | 0.7 | polyethylene (200 P) | 20 |
| b | 0.05 | " | 30 |
| c | 3.0 | " | 20 |
| d | 0.7 | polyethylene (Ceridust 3620) | 20 |
| e | 0.7 | polyethylene (PE-190) | 20 |
| f | 0.1 | polyethylene (100 P) | 30 |
| g | 0.7 | zinc stearate | 20 |
| h | 0.1 | calcium laurate | 30 |
| i | 0.7 | magnesium stearate | 20 |
| j | 0.7 | zinc stearate | 20 |
| k | 0.7 | solid alcohol (mol. wt: 300) | 20 |
| l | 0.7 | solid alcohol (mol. wt.: 450) | 20 |
| m | 0.7 | solid alcohol (mol. wt.: 900) | 20 |
| n | 0.5 (silicon carbide) | titanium coupling agent | |

EXAMPLE 1

| | |
|---|---|
| Styrene-butyl acrylate copolymer (80/20) | 100 parts |
| Carbon black ("Regal 330" produced by Cabot Co., Ltd) | 10 parts |
| Low-molecular weight polypropylene ("Viscol 66OP" produced by Sanyo Kasei Co., Ltd.) | 5 parts |
| Charge control agent ("Bontron P-51" produced by Orient Kagaku Co., Ltd.) | 2 parts |

The above components were melt-kneaded in a Banbury mixer and, after cooling, finely ground in a jet mill. The ground particles were classified to obtain a toner having an average particle size of 10 μm.

A hundred parts of the toner, 1 part of fine titania particles having an average particle size of 0.04 μm, and 0.5 part of Additive A were mixed in a Henschel mixer to prepare a toner of the present invention.

| | |
|---|---|
| Styrene-butyl methacrylate copolymer (80/20) | 100 parts |
| Magnetite ("EPT-1000" produced by Toda | 200 parts |

-continued

| | |
|---|---|
| Kogyo Co., Ltd.) | |
| Polyvinylidene fluoride ("KYNAR" produced by Penn Walt Co.) | 5 parts |

The above components were melt-kneaded in a pressure kneader. The mixture was ground in a turbo-mill and classified to obtain a carrier having an average particle size of 50 μm.

The above prepared toner and the carrier were mixed at a weight ratio of 5:95 to prepare a two-component developer.

EXAMPLE 2

A toner having an average particle size of 10 μm was obtained in the same manner as in Example 1. A hundred parts of the toner were mixed with 0.5 part of hydrophobic silica having an average particle size of 0.012 μm, and 0.5 part of Additive B in a Henschel mixer to prepare a toner of the invention.

The resulting toner and the same carrier as obtained in Example 1 were mixed at a weight ratio of 5:95 to prepare a two-component developer.

EXAMPLE 3

A toner having an average particle size of 10 μm was obtained in the same manner as in Example 1. A hundred parts of the toner were mixed with 1.0 part of Additive C in a Henschel mixer.

The thus treated toner and the same carrier as obtained in Example 1 were mixed at a weight ratio of 5:95 to prepare a two-component developer.

EXAMPLE 4

A toner having an average particle size of 10 μm was obtained in the same manner as in Example 1. A hundred parts of the toner were mixed with 0.5 part of Additive D in a Henschel mixer.

The thus treated toner and the same carrier as obtained in Example 1 were mixed at a weight ratio of 5:95 to prepare a two-component developer.

EXAMPLE 5

| | |
|---|---|
| Styrene-butyl acrylate copolymer (80/20) | 100 parts |
| Carbon black ("Black Pearls 1300" produced by Cabot Co., Ltd) | 10 parts |
| Low molecular weight polypropylene "Viscol 660P" | 5 parts |
| Charge control agent ("Spiron Black THR" produced by Hodogaya Chemical Co., Ltd.) | 2 parts |

The above components were melt-kneaded in a Banbury mixer and, after cooling, finely ground in a jet mill. The ground particles were classified to obtain a toner having an average particle size of 10 μm.

A hundred parts of the toner were mixed with 1.0 part of Additive E in a Henschel mixer.

The thus treated toner was mixed with a carrier comprising a 85 μm ferrite core having been coated with polymethyl methacrylate at a weight ratio of 3:97 to prepare a two-component developer.

EXAMPLE 6

A toner having an average particle size of 10 μm was obtained in the same manner as in Example 5. A hundred parts of the toner were mixed with 0.5 part of Additive F in a Henschel mixer.

The thus treated toner and the same carrier as obtained in Example 5 were mixed at a weight ratio of 3:97 to prepare a two-component developer.

EXAMPLE 7

A toner having an average particle size of 10 μm was obtained in the same manner as in Example 5. A hundred parts of the toner were mixed with 0.5 part of hydrophobic silica having an average particle size of 0.012 μm, and 0.3 part of Additive A in a Henschel mixer.

The thus treated toner and the same carrier as obtained in Example 5 were mixed at a weight ratio of 3:97 to prepare a two-component developer.

COMPARATIVE EXAMPLE 1

A toner having an average particle size of 10 μm was obtained in the same manner as in Example 1. A hundred parts of the toner were mixed with 0.5 part of hydrophobic silica in a Henschel mixer.

The thus treated toner and the same carrier as obtained in Example 1 were mixed at a weight ratio of 5:95 to prepare a two-component developer.

COMPARATIVE EXAMPLE 2

A toner having an average particle size of 10 μm was obtained in the same manner as in Example 1. A hundred parts of the toner were mixed with 0.5 part of hydrophobic silica and 0.2 part of Additive G in a Henschel mixer.

The thus treated toner and the same carrier as obtained in Example 1 were mixed at a weight ratio of 5:95 to prepare a two-component developer.

COMPARATIVE EXAMPLE 3

A toner having an average particle size of 10 μm was obtained in the same manner as in Example 1. A hundred parts of the toner were mixed with 0.5 part of hydrophobic silica and 0.5 part of Additive G in a Henschel mixer.

The thus treated toner and the same carrier as obtained in Example 1 were mixed at a weight ratio of 5:95 to prepare a two-component developer.

COMPARATIVE EXAMPLE 4

A toner having an average particle size of 10 μm was obtained in the same manner as in Example 1. A hundred parts of the toner were mixed with 0.5 part of hydrophobic silica and 0.8 part of Additive G in a Henschel mixer.

The thus treated toner and the same carrier as obtained in Example 1 were mixed at a weight ratio of 5:95 to prepare a two-component developer.

COMPARATIVE EXAMPLE 5

A toner having an average particle size of 10 μm was obtained in the same manner as in Example 5. A hundred parts of the toner were mixed with 0.5 part of hydrophobic silica having an average particle size of 0.012 μm in a Henschel mixer.

The thus treated toner and the same carrier as obtained in Example 5 were mixed at a weight ratio of 3:97 to prepare a two-component developer.

EXAMPLE 8

A toner having an average particle size of 10 μm was obtained in the same manner as in Example 1. A hundred parts of the toner were mixed with 1 part of fine titania particles having an average particle size of 0.04 μm and 0.5 part of Additive H in a Henschel mixer.

The thus treated toner and the same carrier as obtained in Example 1 were mixed at a weight ratio of 5:95 to prepare a two-component developer.

EXAMPLE 9

A toner having an average particle size of 10 μm was obtained in the same manner as in Example 1. A hundred parts of the toner were mixed with 0.5 part of hydrophobic silica having an average particle size of 0.012 μm and 0.5 part of Additive I in a Henschel mixer.

The thus treated toner and the same carrier as obtained in Example 1 were mixed at a weight ratio of 5:95 to prepare a two-component developer.

EXAMPLE 10

A toner having an average particle size of 10 μm was obtained in the same manner as in Example 1. A hundred parts of the toner were mixed with 1.0 part of Additive J in a Henschel mixer.

The thus treated toner and the same carrier as obtained in Example 1 were mixed at a weight ratio of 5:95 to prepare a two-component developer.

EXAMPLE 11

A toner having an average particle size of 10 μm was obtained in the same manner as in Example 5. A hundred parts of the toner were mixed with 1.0 part of Additive K in a Henschel mixer.

The thus treated toner and the same carrier as obtained in Example 5 were mixed at a weight ratio of 3:97 to prepare a two-component developer.

EXAMPLE 12

A toner having an average particle size of 10 μm was obtained in the same manner as in Example 5. A hundred parts of the toner were mixed with 0.5 part of hydrophobic silica having an average particle size of 0.012 μm and 0.3 part of Additive H in a Henschel mixer.

The thus treated toner and the same carrier as obtained in Example 11 were mixed at a weight ratio of 3:97 to prepare a two-component developer.

COMPARATIVE EXAMPLE 6

A toner having an average particle size of 10 μm was obtained in the same manner as in Example 1. A hundred parts of the toner were mixed with 0.5 part of hydrophobic silica and 0.2 part of Additive L in a Henschel mixer.

The thus treated toner and the same carrier as obtained in Example 1 were mixed at a weight ratio of 5:95 to prepare a two-component developer.

COMPARATIVE EXAMPLE 7

A toner having an average particle size of 10 μm was obtained in the same manner as in Example 1. A hundred parts of the toner were mixed with 0.5 part of hydrophobic silica and 0.5 part of Additive L in a Henschel mixer.

The thus treated toner and the same carrier as obtained in Example 1 were mixed at a weight ratio of 5:95 to prepare a two-component developer.

COMPARATIVE EXAMPLE 8

A toner having an average particle size of 10 μm was obtained in the same manner as in Example 1. A hundred parts of the toner were mixed with 0.5 part of hydrophobic silica and 0.8 part of Additive L in a Henschel mixer.

The thus treated toner and the same carrier as obtained in Example 1 were mixed at a weight ratio of 5:95 to prepare a two-component developer.

EXAMPLE 13

A toner having an average particle size of 10 μm was obtained in the same manner as in Example 1. A hundred parts of the toner were mixed with 1 part of fine titania particles having an average particle size of 0.05 μm and 0.5 part of Additive M in a Henschel mixer.

The thus treated toner and the same carrier as obtained in Example 1 were mixed at a weight ratio of 5:95 to prepare a two-component developer.

EXAMPLE 14

A toner having an average particle size of 10 μm was obtained in the same manner as in Example 1. A hundred parts of the toner were mixed with 0.5 part of hydrophobic silica having an average particle size of 0.012 μm and 0.5 part of Additive N in a Henschel mixer.

The thus treated toner and the same carrier as obtained in Example 1 were mixed at a weight ratio of 5:95 to prepare a two-component developer.

EXAMPLE 15

A toner having an average particle size of 10 μm was obtained in the same manner as in Example 1. A hundred parts of the toner were mixed with 1.0 part of Additive O in a Henschel mixer.

The thus treated toner and the same carrier as obtained in Example 1 were mixed at a weight ratio of 5:95 to prepare a two-component developer.

EXAMPLE 16

A toner having an average particle size of 10 μm was obtained in the same manner as in Example 1. A hundred parts of the toner were mixed with 0.5 part of Additive P in a Henschel mixer.

The thus treated toner and the same carrier as obtained in Example 1 were mixed at a weight ratio of 5:95 to prepare a two-component developer.

EXAMPLE 17

A toner having an average particle size of 10 μm was obtained in the same manner as in Example 5. A hundred parts of the toner were mixed with 1.0 part of Additive Q in a Henschel mixer.

The thus treated toner and the same carrier as obtained in Example 5 were mixed at a weight ratio of 3:97 to prepare a two-component developer.

EXAMPLE 18

A toner having an average particle size of 10 μm was obtained in the same manner as in Example 5. A hundred parts of the toner were mixed with 0.5 part of Additive R in a Henschel mixer.

The thus treated toner and the same carrier as obtained in Example 5 were mixed at a weight ratio of 3:97 to prepare a two-component developer.

EXAMPLE 19

A toner having an average particle size of 10 μm was obtained in the same manner as in Example 5. A hundred parts of the toner were mixed with 0.5 part of hydrophobic silica having an average particle size of 0.012 μm and 0.3 part of Additive M in a Henschel mixer.

The thus treated toner and the same carrier as obtained in Example 5 were mixed at a weight ratio of 3:97 to prepare a two-component developer.

COMPARATIVE EXAMPLE 9

A toner having an average particle size of 10 μm was obtained in the same manner as in Example 1. A hundred parts of the toner were mixed with 0.5 part of hydrophobic silica and 0.2 part of Additive S in a Henschel mixer.

The thus treated toner and the same carrier as obtained in Example 1 were mixed at a weight ratio of 5:95 to prepare a two-component developer.

COMPARATIVE EXAMPLE 10

A toner having an average particle size of 10 μm was obtained in the same manner as in Example 1. A hundred parts of the toner were mixed with 0.5 part of hydrophobic silica and 0.5 part of Additive S in a Henschel mixer.

The thus treated toner and the same carrier as obtained in Example 1 were mixed at a weight ratio of 5:95 to prepare a two-component developer.

COMPARATIVE EXAMPLE 11

A toner having an average particle size of 10 μm was obtained in the same manner as in Example 1. A hundred parts of the toner were mixed with 0.5 part of hydrophobic silica and 0.8 part of Additive S in a Henschel mixer.

The thus treated toner and the same carrier as obtained in Example 1 were mixed at a weight ratio of 5:95 to prepare a two-component developer.

Each of the developers prepared in Examples 1 to 19 and Comparative Examples 1 to 11 was tested according to the following test methods. A copying machine "FX-5075" was used for Examples 1 to 4, 8 to 10, and 13 to 16 and Comparative Examples 1 to 4 and 6 to 11, and a copying machine "FX-5039" was used for the other Examples and Comparative Examples, both manufactured by Fuji Xerox Co., Ltd. The results obtained are shown in Tables 4 to 7 below.

1) Charging Properties:

The charge quantity was measured with a blow-off measuring machine "TB 200" manufactured by Toshiba at the initial stage of copying and after obtaining 100,000 copies.

2) Cleaning Performance:

A 5 cm wide black band was formed on the photoreceptor times without transfer, and the surface of the photoreceptor was wiped off with a cleaning blade. The cleaning test was repeated three times.

The cleaning performance was evaluated according to the following rating system:

G1 . . . The toner on the photoreceptor was completely wiped off.

G2 . . . Poor cleaning was slightly observed from the 2500th copy.

G3 . . . Poor cleaning occurred from the 1500th to 2499th copy.

G4 . . . Poor cleaning occurred from the 500th to 1499th copy.

G5 . . . Poor cleaning occurred before the 499th copy.

3) Image Quality:

100,000 copies were produced, and the image quality of the resulting copies and the scratches on the photoreceptor were observed. The results were evaluated according to the following rating system.

G1 . . . Before and after obtaining 100,000 copies, neither image defects, such as black spots, black streaks, and fog, nor scratches on the photoreceptor was observed.

G2 . . . From about the 8000th copy, black streaks attributed to poor cleaning and black spots attributed to scratches on the photoreceptor were observed.

G3 . . . Black spots attributed to scratches on the photoreceptor were observed from about 800th copy, and thereafter, black streaks attributed to poor cleaning also developed.

G4 . . . Black streaks attributed to filming occurred after about the 1000th copy.

G5 . . . Black streaks attributed to filming occurred after about the 800th copy.

G6 . . . Black streaks attributed to poor cleaning and black spots attributed to scratches on the photoreceptor were observed from about the 500th copy.

4) Wear of Photoreceptor:

After obtaining 100,000 copies, the wear of the photoreceptor was measured.

5) Stains on Copy Edges:

A copy as an original was automatically passed 10 times, and stains on the edges of the copy were observed.

G1 . . . No stain was observed.

G2 . . . A slight (thin) stain was observed.

G3 . . . Stains were observed.

TABLE 4

| Example No. | Additive 1 (Amount) (part) | Additive 2 (Amount) (part) | Charge Quantity: Initial Stage (μC/g) | Charge Quantity: After Obtaining 100,000 Copies (μC/g) | Cleaning Performance | Image Quality | Wear of Photoreceptor (μm) | Stains of Copy Edges | Copying Machine Used |
|---|---|---|---|---|---|---|---|---|---|
| Example 1 | A (0.5) | titania (1.0) | 19 | 18 | G2 | G1 | 1.0 | G1 | FX-5075 |
| Example 2 | B (0.5) | hydrophobic silica (0.5) | 13 | 10 | G1 | G1 | <1.0 | G1 | " |
| Example 3 | C (1.0) | — | 15 | 13 | G1 | G1 | 1.0 | G1 | " |
| Example 4 | D (0.5) | — | 15 | 13 | G2 | G1 | 8.0 | G2 | " |
| Compara. Example 1 | — | hydrophobic silica | 20 | 12 | G5 | G2 | 30 | G3 | " |

TABLE 4-continued

| Example No. | Additive 1 (Amount) (part) | Additive 2 (Amount) (part) | Charge Quantity Initial Stage (μC/g) | Charge Quantity After Obtaining 100,000 Copies (μC/g) | Cleaning Performance | Image Quality | Wear of Photoreceptor (μm) | Stains of Copy Edges | Copying Machine Used |
|---|---|---|---|---|---|---|---|---|---|
| Compara. Example 2 | G (0.2) | (0.5) hydrophobic silica (0.5) | 20 | 8 | G4 | G3* | 20 | G3 | " |

Note:
G3*: Black streaks occurred from about the 1800th copy.

TABLE 5

| Example No. | Additive 1 (Amount) (part) | Additive 2 (Amount) (part) | Charge Quantity Initial Stage (μC/g) | Charge Quantity After Obtaining 100,000 Copies (μC/g) | Cleaning Performance | Image Quality | Wear of Photoreceptor (μm) | Stains of Copy Edges | Copying Machine Used |
|---|---|---|---|---|---|---|---|---|---|
| Compara. Example 3 | G (0.5) | hydrophobic silica (0.5) | 22 | 6 | G3 | G4 | 10 | G3 | FX-5075 |
| Compara. Example 4 | G (0.8) | hydrophobic silica (0.5) | 23 | 6 | G2 | G5 | 10 | G3 | " |
| Example 5 | E (1.0) | — | −23 | −20 | G2 | G1 | 3.0 | G1 | FX-5039 |
| Example 6 | F (0.5) | — | −23 | −18 | G1 | G1 | 1.0 | G1 | " |
| Example 7 | A (0.3) | hydrophobic silica (0.5) | −20 | −22 | G2 | G1 | 2.0 | G1 | " |
| Compara. Example 5 | — | hydrophobic silica (0.5) | −13 | −5 | G5 | G6 | 50 | G3 | " |

TABLE 6

| Example No. | Additive 1 (Amount) (part) | Additive 2 (Amount) (part) | Charge Quantity Initial Stage (μC/g) | Charge Quantity After Obtaining 100,000 Copies (μC/g) | Cleaning Performance | Image Quality | Wear of Photoreceptor (μm) | Copying Machine Used |
|---|---|---|---|---|---|---|---|---|
| Example 8 | H (0.5) | titania (1.0) | 18 | 17 | G1 | G1 | 1.0 | FX-5075 |
| Example 9 | I (0.5) | hydrophobic silica (0.5) | 13 | 9 | G2 | G1 | 1.0 | " |
| Example 10 | J (1.0) | — | 15 | 12 | G1 | G1 | <1.0 | " |
| Compara. Example 6 | L (0.2) | hydrophobic silica (0.5) | 21 | 8 | G4 | G3** | 20 | " |
| Compara. Example 7 | L (0.5) | hydrophobic silica (0.5) | 21 | 6 | G3 | G4 | 10 | " |
| Compara. Example 8 | L (0.8) | hydrophobic silica (0.5) | 22 | 4 | G2 | G5 | 5 | " |
| Example 11 | K (1.0) | — | −25 | −22 | G1 | G1 | <1.0 | FX-5039 |
| Example 12 | H (0.3) | hydrophobic silica | −20 | −18 | G1 | G1 | 5 | " |

TABLE 6-continued

| Example No. | Additive 1 (Amount) (part) | Additive 2 (Amount) (part) | Charge Quantity Initial Stage (μC/g) | Charge Quantity After Obtaining 100,000 Copies (μC/g) | Cleaning Performance | Image Quality | Wear of Photoreceptor (μm) | Copying Machine Used |
|---|---|---|---|---|---|---|---|---|
| | | (0.5) | | | | | | |

Note:
G3**: Black streaks occurred from about the 1500th copy.

TABLE 7

| Example No. | Additive 1 (Amount) (part) | Additive 2 (Amount) (part) | Charge Quantity Initial Stage (μC/g) | Charge Quantity After Obtaining 100,000 Copies (μC/g) | Cleaning Performance | Image Quality | Wear of Photoreceptor (μm) | Stains of Copy Edges | Copying Machine Used |
|---|---|---|---|---|---|---|---|---|---|
| Example 13 | M (0.5) | titania (1.0) | 18 | 18 | G1 | G1 | 1.0 | G2 | FX-5075 |
| Example 14 | N (0.5) | hydrophobic silica (0.5) | 14 | 12 | G1 | G1 | <1.0 | G1 | " |
| Example 15 | O (1.0) | — | 15 | 15 | G1 | G1 | <1.0 | G1 | " |
| Example 16 | P (0.5) | — | 15 | 13 | G2 | G1 | 7.0 | G2 | " |
| Compara. Example 9 | S (0.2) | hydrophobic silica (0.5) | 22 | 18 | G4 | G3*** | 10 | G3 | " |
| Compara. Example 10 | S (0.5) | hydrophobic silica (0.5) | 20 | 16 | G3 | G4 | 10 | G3 | " |
| Compara. Example 11 | S (0.8) | hydrophobic silica (0.5) | 20 | 18 | G2 | G5 | 8.0 | G3 | " |
| Example 17 | Q (1.0) | — | −20 | −21 | G1 | G1 | 2.0 | G1 | FX-5039 |
| Example 18 | R (0.5) | — | −19 | −16 | G1 | G1 | <1.0 | G1 | " |
| Example 19 | M (0.3) | hydrophobic silica (0.5) | −18 | −16 | G2 | G1 | 1.0 | G2 | " |

Note:
G3***: Black streaks occurred from about the 1600th copy.

EXAMPLE 20

| | |
|---|---|
| Styrene-butyl methacrylate copolymer (80/20) | 100 parts |
| Carbon black "R-330" (produced by Cabot Co., Ltd) | 10 parts |
| Low molecular weight polypropylene "Viscol 66OP" | 5 parts |
| Nigrosine ("Bontron N-04" produced by Orient Kagaku Co., Ltd.) | 1 part |

The above components were melt-kneaded in a Banbury mixer and, after cooling, finely ground in a jet mill. The ground particles were classified in a classifier to obtain a toner having an average particle size of 11 μm.

A hundred parts of the toner were mixed with 1 part of fine titania particles having an average particle size of 0.05 μm, and 0.5 part of Additive a in a Henschel mixer to prepare a toner.

Ninety parts of a 80 μm copper-zinc ferrite core was coated with 10 parts of a methylphenyl silicone resin by means of a kneader coater to prepare a carrier.

Five parts of the above prepared toner and 100 parts of the carrier were mixed to prepare a two-component developer.

EXAMPLES 21 TO 24

A two-component developer was prepared in the same manner as in Example 20, except for replacing Additive a with each of Additives b to e.

COMPARATIVE EXAMPLE 12

A two-component developer was prepared in the same manner as in Example 20, except that Additive a was not used.

COMPARATIVE EXAMPLE 13

A two-component developer was prepared in the same manner as in Example 20, except for replacing Additive a with Additive G.

EXAMPLE 25

A two-component developer was prepared in the same manner as in Example 20, except for replacing the nigrosine with an azochromium complex "Spiron Black TRH" (produced by Hodogaya Chemical Co., Ltd.) and replacing the fine titania particles with 0.8 part of amorphous hydrophobic fine silica particles "RX 200" (produced by Nippon Aerosil Co., Ltd.) having an average particle size of 0.012 μm.

EXAMPLE 26

A two-component developer was prepared in the same manner as in Example 25, except for replacing Additive a with Additive f.

COMPARATIVE EXAMPLE 14

A two-component developer was prepared in the same manner as in Example 25, except that Additive a was not used.

EXAMPLES 27 TO 29

A two-component developer was prepared in the same manner as in Example 20, except for replacing Additive a with each of Additives g to i.

COMPARATIVE EXAMPLE 15

A two-component developer was prepared in the same manner as in Example 20, except for replacing Additive a with Additive L.

EXAMPLES 30 AND 31

A two-component developer was prepared in the same manner as in Example 25, except for replacing Additive a with Additive g or j.

EXAMPLES 32 TO 34

A two-component developer was prepared in the same manner as in Example 20, except for replacing Additive a with each of Additives k to m.

COMPARATIVE EXAMPLES 16 AND 17

A two-component developer was prepared in the same manner as in Example 20, except for replacing Additive a with Additive S or n.

EXAMPLES 35 AND 36

A two-component developer was prepared in the same manner as in Example 25, except for replacing Additive a with Additive k or m.

Each of the developers obtained in Examples 20 to 36 and Comparative Examples 12 to 17 was tested in the same manner as in Example 1. A copying machine "VIVACE 400 Reformed Model" was used for Examples 20 to 24, 27 to 29 and 32 to 34 and Comparative Examples 12, 13, and 15 to 17, and a copying machine "FX-5039" was used for Examples 25, 26, 30, 31, 35 and 36 and Comparative Example 14, both manufactured by Fuji Xerox Co., Ltd. The results obtained are shown in Tables 8 to 10 below.

TABLE 8

| Example No. | Additive 1 (Amount) (part) | Additive 2 (Amount) (part) | Charge Quantity: Initial Stage (μC/g) | Charge Quantity: After Obtaining 100,000 Copies (μC/g) | Cleaning Performance | Image Quality | Wear of Photoreceptor (μm) | Stains of Copy Edges | Copying Machine Used |
|---|---|---|---|---|---|---|---|---|---|
| Example 20 | a (0.5) | titania (1.0) | 21 | 18 | G1 | G1 | <1.0 | G1 | VIVACE 400 |
| Example 21 | b (0.5) | titania (1.0) | 21 | 17 | G2 | G1 | <1.0 | G1 | " |
| Example 22 | c (0.5) | titania (1.0) | 23 | 18 | G2 | G1 | 6.0 | G2 | " |
| Example 23 | d (0.5) | titania (1.0) | 20 | 18 | G1 | G1 | <1.0 | G1 | " |
| Example 24 | e (0.5) | titania (1.0) | 20 | 16 | G1 | G1 | 1.0 | G1 | " |
| Compara. Example 12 | — | titania (1.0) | 21 | 20 | G5 | G2 | 40 | G3 | " |
| Compara. Example 13 | G (0.5) | titania (1.0) | 23 | 18 | G3 | G4 | 10 | G3 | " |
| Example 25 | a (0.5) | hydrophobic silica (0.8) | −17 | −15 | G1 | G1 | <1.0 | G1 | FX-5039 |
| Example 26 | f (0.5) | hydrophobic silica (0.8) | −16 | −14 | G1 | G1 | <1.0 | G1 | " |

TABLE 9

| Example No. | Additive 1 (Amount) (part) | Additive 2 (Amount) (part) | Charge Quantity: Initial Stage (μC/g) | Charge Quantity: After Obtaining 100,000 Copies (μC/g) | Cleaning Performance | Image Quality | Wear of Photoreceptor (μm) | Stains of Copy Edges | Copying Machine Used |
|---|---|---|---|---|---|---|---|---|---|
| Compara. Example 14 | — | hydrophobic silica (0.8) | −19 | −13 | G5 | G6 | 50 | G3 | FX-5039 |
| Example 27 | g | titania | 20 | 17 | G1 | G1 | <1.0 | G1 | VIVACE 400 |

TABLE 9-continued

| Example No. | Additive 1 (Amount) (part) | Additive 2 (Amount) (part) | Charge Quantity Initial Stage (μC/g) | Charge Quantity After Obtaining 100,000 Copies (μC/g) | Cleaning Performance | Image Quality | Wear of Photoreceptor (μm) | Stains of Copy Edges | Copying Machine Used |
|---|---|---|---|---|---|---|---|---|---|
| | (0.5) | (1.0) | | | | | | | |
| Example 28 | h (0.5) | titania (1.0) | 19 | 15 | G2 | G1 | 2.0 | G1 | " |
| Example 29 | i (0.5) | titania (1.0) | 17 | 15 | G1 | G1 | 1.0 | G1 | " |
| Compara. Example 15 | L (0.5) | titania (1.0) | 25 | 13 | G3 | G4 | 10 | G3 | " |
| Example 30 | g (0.5) | hydrophobic silica (0.8) | −19 | −15 | G1 | G1 | 1.0 | G1 | FX-5039 |
| Example 31 | j (0.5) | hydrophobic silica (0.8) | −18 | −15 | G1 | G1 | <1.0 | G1 | " |

TABLE 10

| Example No. | Additive 1 (Amount) (part) | Additive 2 (Amount) (part) | Charge Quantity Initial Stage (μC/g) | Charge Quantity After Obtaining 100,000 Copies (μC/g) | Cleaning Performance | Image Quality | Wear of Photoreceptor (μm) | Stains of Copy Edges | Copying Machine Used |
|---|---|---|---|---|---|---|---|---|---|
| Example 32 | k (0.5) | titania (1.0) | 21 | 20 | G1 | G1 | 2.0 | G1 | VIVACE 400 |
| Example 33 | l (0.5) | titania (1.0) | 20 | 18 | G1 | G1 | <1.0 | G1 | " |
| Example 34 | m (0.5) | titania (1.0) | 20 | 20 | G2 | G1 | 5.0 | G2 | " |
| Compara. Example 16 | S (0.5) | titania (1.0) | 21 | 17 | G3 | G4 | 10 | G3 | " |
| Compara. Example 17 | n (0.5) | titania (1.0) | 18 | 14 | G4 | G6 | 60 | G3 | " |
| Example 35 | k (0.5) | hydrophobic silica (0.8) | −20 | −19 | G1 | G1 | 1.0 | G1 | FX-5039 |
| Example 36 | m (0.5) | hydro phobic silica (0.8) | −19 | −17 | G2 | G1 | 7.0 | G2 | " |

The electrophotographic dry toner according to the present invention exhibits satisfactory fluidity, satisfactory cleanability, excellent environmental stability, and excellent durability. The dry toner of the present invention causes no toner filming phenomenon on a photoreceptor, a carrier used in a two-component developer system, or a charging part used in a one-component developer system so that the resulting copies are free from images defects, such as white spots or faint image.

While the invention has been described in detail and with reference to specific examples thereof, it will be apparent to one skilled in the art that various changes and modifications can be made therein without departing from the spirit and scope thereof.

What is claimed is:

1. An electrophotographic dry toner comprising a binder resin and a colorant, said toner having externally added thereto spherical fine silica particles that have been surface treated with at least one treating agent selected from the group consisting of a polyethylene, a fatty acid metal salt, and an alcohol containing from 20 to 60 carbon atoms which is solid at ordinary temperatures, wherein said spherical fine silica particles have an average particle size before treatment of from 0.05 to 3.0 μm, a bulk density of at least 300 g/l and a density of at least 2.1 mg/mm$^3$.

2. An electrophotographic dry toner as claimed in claim 1, wherein said polyethylene has a specific gravity of not less than 0.9 and an average molecular weight of not more than 9000.

3. An electrophotographic dry toner as claimed in claim 1, wherein said fatty acid metal salt is selected from the group consisting of aluminum stearate, calcium laurate, calcium myristate, calcium stearate, zinc laurate, zinc myristate, zinc stearate, and magnesium stearate.

4. An electrophotographic dry toner as claimed in claim 1, wherein said alcohol has an average molecular weight of from about 290 to 860.

5. An electrophotographic dry toner as claimed in claim 1, wherein said spherical fine silica particles have coated thereon from 2 to 50% by weight of said treating agent.

6. An electrophotographic dry toner as claimed in claim 1, wherein the spherical fine silica particles have an average particle diameter after treatment of not more than 5 μm.

7. An electrophotographic dry toner comprising a binder resin and a colorant, said toner having externally added thereto fine silica particles that have been surface treated with at least one treating agent selected from the group consisting of a polyethylene, a fatty acid metal salt, and an alcohol containing from 20 to 60 carbon atoms which is solid at ordinary temperatures, wherein said fine silica particles have an average particle size before treatment of from 10 to 40 nm.

* * * * *